US005230750A

United States Patent [19]

Shindou et al.

[11] Patent Number: 5,230,750

[45] Date of Patent: Jul. 27, 1993

[54] CHROMATING METHOD OF ZINC-BASED PLATED STEEL SHEET

[75] Inventors: Yoshio Shindou; Motoo Kabeya; Shiro Fujii, all of Chiba; Makoto Yoshida; Teruaki Izaki, both of Fukuoka; Takao Ogino, Tokyo; Arata Suda, Tokyo; Takayuki Aoki, Tokyo, all of Japan

[73] Assignee: Nihon Parkerizing Co., Ltd., Tokyo, Japan

[21] Appl. No.: 770,022

[22] Filed: Oct. 2, 1991

[30] Foreign Application Priority Data

Oct. 5, 1990 [JP] Japan ..... 2-268041

[51] Int. Cl.[5] ..... C23C 22/33

[52] U.S. Cl. ..... 148/258; 148/267

[58] Field of Search ..... 148/258, 251, 267

[56] References Cited

U.S. PATENT DOCUMENTS 5,141,575 8/1992 Yoshitake ..... 148/258

FOREIGN PATENT DOCUMENTS 0391442 10/1990 European Pat. Off. .
58-22383 2/1983 Japan .
0193278 11/1984 Japan ..... 148/258
60-218483 11/1985 Japan .
61-584 6/1986 Japan .
62-83478 4/1987 Japan .
2-267277 1/1990 Japan .
2-209489 8/1990 Japan .

*Primary Examiner*—Sam Silverberg
*Attorney, Agent, or Firm*—Armstrong, Westerman, Hattori, McLeland & Naughton

[57] ABSTRACT

A chromating liquid for forming a chromate film on a Zn or Zn-alloy plated steel sheet, is prepared by adding and mixing a silane coupling agent in a molar ratio of from 0.05 to 0.3 relative to $Cr^{6+}$ contained in an aqueous chromating liquid which contains 1-30 g/l of $Cr^{6+}$ and 1-30 g/l of $Cr^{3+}$ at a weight ratio of $Cr^{6+}/Cr^{3+}$ ranging from 0.1 to 2.0; and further contains 1-59 g/l of hydrofluoric acid and 1-59 g/l of phosphoric acid at total of hydrofluoric acid and phosphoric acid ranging from 2 to 60 g/l and at a weight ratio of (fluoride ions+phosphate ions)/$Cr^{3+}$ ranging from 0.5 to 3.5. and, further said chromating liquid is applied on a surface of the zinc-based plated steel sheet and is then dried, thereby forming the chromate film having a coating amount of from 10 to 150 mg/m$^2$ in terms of the chromium.

8 Claims, 2 Drawing Sheets

✳····REDUCTION BY METHANOL

CHROMATING METHOD OF ZINC-BASED PLATED STEEL SHEET

BACKGROUND OF INVENTION

1. Field of Invention

The present invention relates to a chromating method of zinc electroplated steel sheet, zinc-nickel electroplated steel sheet, and Galvannealed steel sheet (these steel sheets are hereinafter referred to as the zinc-based plate steel sheets). Particularly, the chromate film formed by the method of the present invention exhibits, even after drying at low temperature and/or for a short time, improved corrosion-resistance, alkali-resistance, welding-resistance and coating-performance (i.e., adhesion and corrosion-resistance of painted film).

2. Description of Related Arts

Heretofore, the chromating liquid has been an aqueous solution containing chromic acid and bichromate, and enabling the formation of chromate film which is difficult-to-dissolve when treated by acid or alkali.

Various methods for forming the chromate film have been proposed. The previously proposed methods as well as their merits and drawbacks are hereinafter described.

Japanese Unexamined Patent Publication No. 50-158535 relates to a method for forming a difficult-to-dissolve chromate film and discloses the chromating liquid, which contains chromic acid anhydride, phosphoric acid and water-soluble or water-dispersed polymer. Seventy percent more of the hexavalent chromium ions contained in the chromating liquid is reduced by a reducing agent, such as ethylene glycol or the like. The polymer contained in the chromate film improves the dissolving resistance, corrosion-resistance and coating-performance, but disadvantageously impairs the weldability.

Japanese Patent Publication No. 61-58552 discloses the chromating liquid, which contains chromic acid, chromate-reducing product and silica sol.

When the chromate film is formed on a zinc-based plated steel sheet by the above-mentioned chromating liquid and is then worked and painted, specially hexavalent chromium ions are liable to dissolve away from the chromate film because of alkali washing before the painting.

As the result, the corrosion-resistance of the chromate film is deteriorated.

Japanese Unexamined Patent Publication Nos. 58-22383 and 62-83478 disclose a method to reduce the hexavalent chromium ions contained in the chromating liquid by a silane coupling agent. The chromate film produced by the methods disclosed in said publications exhibits excellent adhesion of the paint coating. However, the chromate film produced by Japanese Unexamined Patent Publication No. 58-22383 is free of phosphoric acid and hence exhibits poor alkali-resistance. The chromate film produced by Japanese Unexamined Patent Publication No. 62-83478 exhibits also poor alkali-resistance. In the conventional chromating method described above, the ingredients are considered to have the following tendencies. Polymer and silica enhance corrosion-resistance but impair alkali-resistance. There is a tendency for the hexavalent chromium ions in the chromating liquid to be reduced by the silane coupling agent, with the result that the concentration of the hexavalent chromium ions gradually decreases during the film formation, thereby destabilizing the corrosion-resistance of the chromate film.

Since the performance of the chromate film is strongly dependent on the drying condition, the chromate film which is formed by any one of the various methods proposed as above exhibits poor performance when dried at a low temperature and/or for a short period of time.

SUMMARY OF INVENTION

It is an object of the present invention to provide a chromating method which can eliminate the disadvantages of the prior art described above and which can particularly form at a low drying-temperature and/or for a short drying time a chromate film which exhibits improved corrosion-resistance, welding-resistance and coating-performance.

In order to solve the problems involved in the conventional chromating of a zinc-based plated steel sheet, the present inventors considered the following points of the aqueous chromating solution.

(1) Phosphoric acid and hydrofluoric acid are to be contained in the chromating liquid so as to improve alkali-resistance and corrosion-resistance of the chromate film.

(2) The total of hydrofluoric acid and phosphoric acid is to be quantitatively determined relative to the trivalent chromium ions.

(3) The hexavalent chromium ions, the trivalent chromium ions and the total chromium ions, are to be quantitatively determined relative to the silane coupling agent.

From consideration of the above points, it was discovered that: hydrofluoric acid and phosphoric acid may synergistically act; the hexavalent chromium ions undergo a reducing reaction due to the silane coupling agent during the drying step of the chromating liquid applied on a zinc-based plated sheet; and the silanol groups of the silane coupling agent form a network bonding with one another, thereby forming a strong film even by drying at low temperature or for a short period of time.

As a result, there is provided a chromate film having improved corrosion-resistance, alkali-resistance, welding-resistance and coating performance.

The present invention relates to a chromating method on a zinc-based plated steel sheet, from 10 to 150 $mg/m^2$ of the following aqueous chromium liquid in terms of the chrome in the film.

The chromating liquid according to the present invention is prepared by adding and mixing a silane coupling agent in a molar ratio of from 0.05 to 0.3 relative to the hexavalent chromium concentration contained in the aqueous chromating liquid which contains from 1 to 30 g/l of hexavalent chromium ions and from 1 to 30 g/l of trivalent chromium ions at a weight ratio of hexavalent chromium ions/trivalent chromium ions ranging from 0.1 to 2.0; and further contains from 1 to 59 g/l of hydrofluoric acid and from 1 to 59 g/l of phosphoric acid at total of hydrofluoric acid and phosphoric acid ranging from 2 to 60 g/l and at a weight ratio of (fluoride ions+phosphate ions)/trivalent chromium ions ranging from 0.5 to 3.5 and, may further contain from 0.1 to 10 g/l of zinc ions and/or from 0.1 to 10 g/l of nickel ions.

The aqueous chromating liquid according to the present invention is first described.

The present aqueous chromating liquid contains water as solvent, and from 1 to 30 g/l of hexavalent chromium ions and from 1 to 30 g/l of trivalent chromium ions as the basic ingredients. When the concentration of the hexavalent and trivalent chromium ions is less than 1 g/l, respectively, it is difficult to form a chromate film having satisfactory corrosion-resistance. On the other hand, when the concentration of hexavalent chromium ions and trivalent chromium ions exceeds 30 g/l, respectively, the viscosity of the chromating liquid is increased and, further, the stability of the chromating liquid is impaired, thereby making it difficult to control the coating weight. The ratio of the hexavalent chromium ions/trivalent chromium ions is important for determining the amount of chromium in the chromating liquid. The weight ratio of the hexavalent chromium ions/trivalent chromium ions must be in the range of from 0.1 to 2.0. When the weight ratio of the hexavalent chromium ions/trivalent chromium ions is less than 0.1, the chromating liquid tends easily to form gel and the corrosion-resistance of the chromate film formed is impaired. On the other hand, when the weight ratio of the hexavalent chromium ions/trivalent chromium ions is more than 2.0, the concentration of hexavalent chromium ions increases in proportion to the increase of such ratio, with the result that reduction of the hexavalent chromium ions by the silane coupling agent easily occurs, when the silane coupling agent is blended with the aqueous chromating liquid. The quality of the chromating liquid therefore deteriorates. It is possible to control the weight ratio of the chromium ions mentioned above by means of adding a known reducing agent, such as ethanol, methanol, oxalic acid, starch, sucrose, and the like. It is also possible to control such ratio by dissolving a trivalent chromium compound, such as chromium carbonate, basic chromium carbonate, chromium hydroxide and the like into hydrofluoric acid, the phosphoric acid, chromic acid, and the like.

With regard to the hydrofluoric acid and phosphoric acid contained in the inventive aqueous chromating liquid, the total of the hydrofluoric acid and phosphoric acid must be from 2 to 60 g/l. When the total of the hydrofluoric acid and phosphoric acid is less than 2 g/l, corrosion-resistance and alkali-resistance of the chromate film are lessened. On the other hand, if such total is more than 60 g/l, and when the silane coupling agent is added to prepare the inventive chromating liquid, the silane coupling agent rapidly reduces the hexavalent chromium ions, thereby deteriorating the qualities of the chromate liquid. The concentration of hydrofluoric acid and phosphoric acid is preferably not less than 1 g/l and not more than 59 g/l. It is particularly important in determining the total amount of the hydrofluoric acid and phosphoric acid that said total amount is adjusted relative to the trivalent chromium ions. The weight ratio of (fluoride ions+phosphate ions)/trivalent chromium ions must be in the range of from 0.5 to 3.5. When this ratio is less than 0.5. alkali-resistance and corrosion-resistance of the chromate film tends to lessen. On the other hand, when the ratio is more than 3.5, the drying property of the chromate film is impaired, making it likely to absorb moisture. This results in reduction in corrosion-resistance of painted film.

The aqueous chromating liquid may contain, if necessary, from 0.1 to 10 g/l or zinc ions and/or from 0.1 to 10 g/l of nickel ions so as to further improve alkali-resistance and corrosion-resistance. When the concentration of zinc or nickel ions is less than 0.1 g/l, its improvement effects are not easily detectable. On the other hand, when the above-mentioned concentration is more than 10 g/l, the trivalent chromium ions are liable to disadvantageously precipitate. The zinc ions may be added to the aqueous chromating liquid in the form of zinc oxide, zinc carbonate, zinc hydroxide, zinc phosphate, or zinc fluoride. The nickel ions may be added to the aqueous chromating liquid in the form of nickel carbonate, basic nickel carbonate, nickel hydroxide, or nickel fluoride.

When the chromate liquid is applied on a zinc-based plating steel sheet, the silane coupling agent is preferably preliminarily added to and blended with the aqueous chromating liquid in a molar ratio of the silane coupling agent relative to the hexavalent chromium ions (silane coupling agent/hexavalent chromium ions) in the range of from 0.05 to 0.3. However, all the ingredients may be blended with one another directly before application of the chromating liquid.

The silane coupling agent is not limited to a specific one but is preferably one expressed by the following general formula (1) or (2).

$$(YR)_mSiX_n \quad (1)$$

$$Y_mSiX_n \quad (2)$$

$m+n=4$ and $n=1-3$

R: alkyl group

X: hydrolyzable group bonded to the silicon atoms, such as methoxy or ethoxy group Y: organic functional group, such as vinyl group, mercapto group, glycidoxy group or methacryloxy group.

The embodiments of the silane coupling agent are vinyltrimethoxysilane, vinyltriethoxysilane, γ-dimercaptopropyltrimethoxysilane γ-glycidoxypropyltrimethoxysilane, γ-glycidoxypropylmethyldimethoxysilane, γ-methacryloxypropyltrimethoxysilane, γ-methacryloxypropylmethyldimethoxysilane, and the like.

When the molar ratio of the added silane coupling agent relative to the hexavalent chromium ions is less than 0.05, alkali-resistance of chromate film is not satisfactory. On the other hand, when such ratio is more than 0.3, the chromating liquid exhibits a tendency for gradual lessening of stability, that is, the trivalent chromium ions gradually increase in the chromating liquid, which then tends to gel easily. The above-mentioned molar ratio is preferably in the range of from 0.1 to 0.2.

The chromating liquid, in which the silane coupling agent has been blended as described above, is applied on the surface of a zinc-based plated steel sheet by means of, for example, a roll-coater and is then dried so as to form a chromate film having a deposition amount of from 10 to 150 mg/m$^2$ in terms of metallic chromium. When the deposition amount of chromium is less than 10 mg/m$^2$, the corrosion-resistance of chromate film and the corrosion resistance of painted film are unsatisfactory. On the other hand, when the deposition amount of the chromium is more than 150 mg/m$^2$, it is difficult to control the deposition amount. Moreover, the effect of enhancing the corrosion-resistance is saturated, that is, corrosion-resistance does not increase with the increase in the deposition amount. Furthermore, the so-heavily deposited chromate film is easily removed when exposed to an external force, with the result that the welding resistance and adhesion property of painted film are impaired.

The drying conditions at a low temperature and/or for a short period of time according to the present invention are not specified at all. However, the properties of the chromate film are fully realized even when dried at a temperature less than 100° C. and for a time of less than 5 seconds.

The aqueous chromate liquid having the composition as described above have desirably pH of from approximately 1 to 3.

When the silane coupling agent is blended with the aqueous chromate liquid and the so-prepared chromate liquid is applied on a zinc-based plating steel sheet and is then dried, ingredients of the chromating liquid, i.e., the trivalent and hexavalent chromium ions, hydrofluoric acid and phosphoric acid are caused to react with the plating surface mainly due to the heat energy at the drying step. The compounds forming the chromate film are the following colorless compounds (a), green compounds (b) and (c), and golden compounds (d) and (e).

| | | |
|---|---|---|
| (a) | $ZnF_n(OH)_m$ | $n + m = 2, (n = 0–2)$ |
| (b) | $Zn_3(PO_4)_2.4H_2O$ | |
| (c) | $NiF_n(OH)_m$ | $n + m = 2, (n = 0–2)$ |
| (d) | $Ni_3(PO_4)_2.8H_2O$ | |
| (e) | $CrF_x(OH)_4$ | $x + y = 3, (x = 0–3)$ |
| (f) | $CrPO_4.6H_2O$ | |
| (g) | Zinc-chromate compounds expressed as $ZnO.3Zn(OH)_2.CrO_3$, $3Zn(OH)_2.CrO_3$, $2Zn(OH)_2.CrO_3$ | |
| (h) | $Cr(OH)_3.Cr(OH).CrO_4$ (Chromic Chromate) | |

The reaction of the silane coupling agent is described with reference to an example of one having a trimethoxy group, which is expressed by $YRSi(OCH_3)_3$. A reaction is the hydrolysis reaction expressed by the following formula (1).

$$YRSi(OCH_3)_3+3H_2O\rightarrow(i)\ YRSi(OH)_3+3CH_3OH \quad (1)$$

Figure 1:
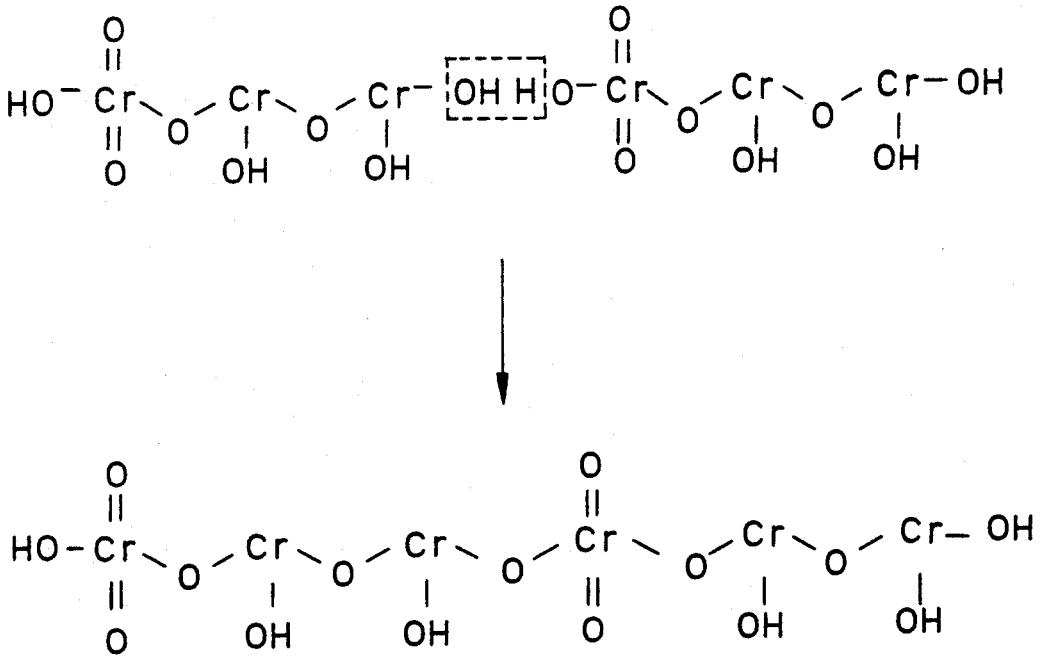
FIG. 1 illustrates the condensation reaction between the silanol group and chromic chromate.

When the chromating liquid, in which the hydrolysis reaction described has occurred, is applied and dried, the following reactions are believed to occur even under the conditions of low drying temperature and short drying time. The silanol groups react with, for example, chromic chromate (h), with the result that a condensation reaction occurs as shown in FIG. 1. In addition, the chromic chromate (h) is cross-linked with the hydrolysis product (i) as described above, as shown in FIG. 2. Methanol reduces the hexavalent chromium ions in the chromic chromate.

Complicated bonding between the chromic chromate and the hydrolysis products occurs to form a network structure of high molecule-coupling.

Figure 2:
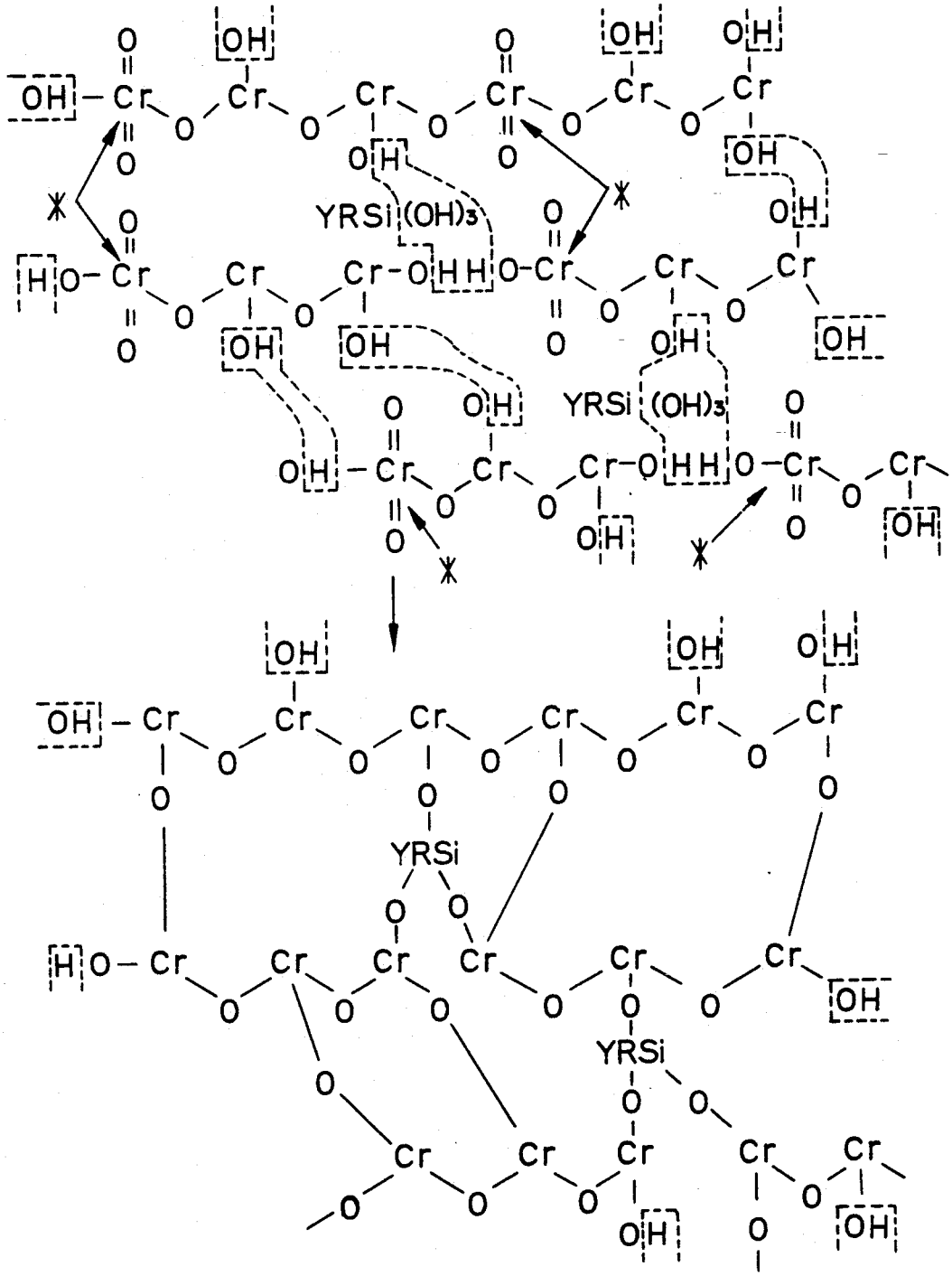
FIG. 2 illustrates the cross-linking reaction of the chromic chromate.

The compounds (a), (b), (c), (d), (e), (f), and (g) seem to be enclosed in the network structure of the high-molecular chromium compounds shown in FIGS. 1 and 2 or be bonded with these high-molecular compounds. The alkali-resistance of a chromate film is high because of the network molecular structure and formed as described above as well as by the coupling effects due to the silanol groups.

The chromium is therefore difficult to dissolve when the chromate film is subjected to rinsing by an alkaline cleaning solution. The network structure of high molecular chromium compounds seems to contribute to enhance the corrosion-resistance.

Since the chromate film according to the present invention is free of organic polymer, its alkali-resistance is high. In addition, since intercoat insulation resistance is relatively low, this contributes to enhance the welding-resistance of the chromate film. The present invention is further described with reference to the examples and comparative examples.

EXAMPLES

(1) Method for Preparing Chromate Coating Liquid

The chromate coating liquid A given in Table 1 was prepared by: first dissolving 200 g of chromic acid anhydride with 500 g of water; adding 83 g of phosphoric acid (75% aqueous solution) and 18 g of methanol into the resultant solution; heating the resultant solution at 80°–90° C. for 1 hour thereby reducing hexavalent chromium ions to provide the weight ratio of trivalent chromium ion/hexavalent chromium ions of 1.0; cooling the solution; adding hydrofluoric acid (55% aqueous solution) at a concentration of 36 g/l; further adding water to obtain total weight of 1 kg. This liquid is hereinafter referred to as the aqueous chromating solution.

The aqueous chromating solution was then diluted so that the total chromium concentration is 25 g/l. Thus, the chromate coating liquid A was prepared.

The chromate coating liquids B through K were prepared by the same preparation method as for the chromate coating liquid A, so as to provide the compositions as given in Table 1.

(2) Chromating Method

The chromate coating liquids prepared as described above were applied on the surface of zinc electro-plated steel sheets, and zinc-nickel electro-plated steel sheets, by the following process, followed by drying. The properties of the chromate coating are shown in Table 2.

Steel sheets to be treated (*1)→alkali-degreasing (*2)→water rinsing→roll squeezing→drying (air-blow drying)→application of chromate coating liquids→roll squeezing→drying (*3)

Remarks *1—One grade of the steel sheets to be treated is the both side Zn electro-plated steel sheet. The Zn plating amount is 20 g/m² on both surfaces. The other grade of the steel sheets is both side Zn-Ni electroplated steel sheet. The plating amount is 20 g/m² on both surfaces. The Ni content of the plating layer is 11 wt %.

The size of the steel sheets is 200×300 mm and 0.8 mm thick. The steel sheets are oiled sheets.

*2—The alkali cleaning was carried out by spraying 2% aqueous solution of a weakly alkaline cleaner solution (PALKLIN 342, product of Nihon Parkerizing Co., Ltd.) at 60° C. for 30 seconds.

*3—In the air-blow drying, the steel sheets having sheet temperature of 60° C. were dried for 4 seconds.

(3) Preparation of Paint-Coated Steel Sheets

The chromated steel sheets were subjected, directly or after the alkali-cleaning in item (4) (a) below, to coating with a thermosetting melamine alkyd paint (DERICON 700 white, product of Dai Nihon Paint Co., Ltd.) and then to baking at 140° C. for 20 minutes. The paintcoated sheets (thickness of the paint coating—25 μm) were thus prepared.

(4) Evaluation Test of Properties (a) Alkali-Resistance Test

The chromated steel sheets were subjected to alkali cleaning under the following condition. The amounts of deposited chromium ($mg/m^2$) before and after the cleaning were measured by fluorescent X-ray. The alkali-resistance is indicated by the following formula, that is, the smaller the percentage, the better alkali-resistance. Zero percent indicates that the chromate film is not influenced at all by the alkaline cleaning solution.

$$\text{The alkali-resistance} = \frac{A - B}{A} \times 100(\%)$$

A: amount of deposited chromium before alkali-cleaning ($mg/m^2$)

B: amount of deposited chromium after alkali-cleaning ($mg/m^2$)

The alkali cleaning was carried out by spraying 2% aqueous solution of an alkali cleaner mainly composed of sodium silicate (PALKLIN N364S, a product of Nihon Parkerizing Co., Ltd.) at 60° C. for 2 minutes.

(b) Corrosion Resistance

Zinc Electro-plated Steel Sheets

The salt spray test stipulated in JIS-Z-2371 was carried out for 150 hours using the specimens 70×150 mm in size, before and after the alkali cleaning. The corrosion-resistance was evaluated from the area of white rust relative to the total area of the specimens.

◎ : Area of generated white rust-0%

○: ditto—less than 10%

Δ: ditto—not less than 10% and less than 30%

X: ditto—not less than 30%

Zinc-Nickel Alloy Electro-plated Steel Sheet

The specimens before and after the alkali cleaning were subjected to a composite corrosion test of 50 cycles, in which one cycle consisted of salt spraying of 4 hours, drying (at 60° C.) for 2 hours, and exposure to humid atmosphere (50° C., 95% or more of RH) for 2 hours. The corrosion-resistance was evaluated from the area of red rust relative to the total area of the specimens.

◎ : Area of generated red rust-0%

○: ditto—less than 10%

Δ: ditto—not less than 10% and less than 30%

X: ditto—not less than 30%

(c) Corrosion Resistance of Paint-Coated Sheet

The paint coating was cut by a cutter so that the scribes reached the substrate metal of the specimens. The zinc electro-plated steel sheets and the zinc-nickel electro-plated steel sheets were subjected to the salt spray test for 200 hours and 300 hours, respectively. The paint coating was then peeled by an adhesive tape (cellophane tape). The corrosion-resistance was judged by the maximum peeling width (in mm) at one side of the scribes.

(d) Adhesion of Paint Coating

Cross Cut Test

The specimens were subjected to paint coating without preliminary alkali-cleaning, and then the surface of the specimens was cut by a cutter into 1 mm square sections.

An adhesive tape (cellophane tape) was adhered on the testing surface and then rapidly peeled. The peeling degree of the paint coating was then observed.

Erichsen Cup Test

The specimens were subjected to paint coating without preliminary alkali-cleaning and were then extruded 6 mm using an Erichsen Tester.

An adhesive tape (cellophane tape) was adhered on the testing surface and then rapidly peeled. The failure of the paint coating was then observed.

The adhesion of the paint coating was judged by the peeling degree of the paint coating and under the following four criterions ◎ : peeling of paint coating-0%

○: ditto—less than 10%

Δ: ditto—not less than 10% and less than 30%

X: ditto—not less than 30%

(e) Weldability Test

The zinc-nickel alloy electro-plated steel sheets were subjected to the spot welding under the following conditions. The chromated surface of one specimen 30×100 mm in size and the non-chromated surface of another specimen 30×100 mm in size were each welded in one hundred spots. The above-mentioned welding was repeated for other specimens so as to detect the deterioration of the welding tips. The so-welded specimens were subjected to the tensile test. The number of spots by which 400 kg of tensile strength could not be maintained was recorded.

Welding Surface: Chromated surface of specimens and the non-chromated surface of other specimens Pressing Force: 200 kg Current: 8.5A Current Conduction Time: 10 cycles Electrode: R40(radius type) Material: chromium-copper alloy As is apparent from the above, the inventive examples exhibit improved corrosion-resistance, alkali-resistance, welding-resistance and coating performance (adhesion and corrosion-resistance) of painted film.

Contrary to this, the alkali-resistance and coating-performance of the comparative examples 3, 4, 6, 7, 8 and 9 are clearly poor. The corrosion-resistance, corrosion-resistance and adhesion of the paint coating of the comparative examples 1, 2, 5, 6 and 7 are poor.

TABLE 1-A

| | | Inventive Chromating Liquid | | | | | | |
|---|---|---|---|---|---|---|---|---|
| | | A | B | C | D | E | F | G |
| Aqueous Chromating Liquid | $Cr^{6+}$ (g/l) | 12.5 | 5 | 1 | 24 | 18 | 15 | 18 |
| | $Cr^{3+}$(g/l) | 12.5 | 20 | 5 | 16 | 10 | 10 | 10 |
| | Hydrofluoric Acid (g/l) | 5.3 | 15.8 | 2.1 | 15.8 | 10.5 | 12.6 | 12.6 |

TABLE 1-A-continued

| | Inventive Chromating Liquid | | | | | | |
|---|---|---|---|---|---|---|---|
| | A | B | C | D | E | F | G |
| Phosphoric Acid (g/l) | 15.5 | 15.5 | 1.0 | 30.9 | 5.2 | 20.6 | 20.6 |
| $F^-$ + $PO_4^{3-}$ (g/l) | 20 | 30 | 3 | 45 | 15 | 32 | 35 |
| $Cr^{6+}/Cr^{3+}$ | 1.0 | 0.4 | 0.2 | 1.5 | 1.8 | 1.5 | 1.8 |
| $(F^- + PO_4^{3-})/Cr^{3+}$ | 1.6 | 1.5 | 0.6 | 2.8 | 1.5 | 3.2 | 3.2 |
| $Zn^{2+}$ (g/l) *1 | 0 | 0 | 0 | 0 | 5 | 0 | 5 |
| $Ni^{2+}$(g/l) *2 | 0 | 0 | 0 | 0 | 0 | 5 | 5 |
| Silane coupling agent (g/l) | a)5.7 | b)2.4 | c)0.2 | a)16.3 | a)14.7 | a)5.4 | a)8.2 |
| Molar ratio. Silane coupling Agent/$Cr^{6+}$ | 0.10 | 0.10 | 0.05 | 0.15 | 0.18 | 0.08 | 0.10 |

*1 — ZnO is used for $Zn^{2+}$
*2 — $NiCO_3$ is used for $Ni^{2+}$
*3 — The silane coupling agent is the following a), b) or c) and is added to and blended with the aqueous chromating liquid. The so-prepared chromating liquid is applied on a steel sheet.
a)γ-glycidoxypropyltrimethoxysilane
b)γ-methacryloxypropyltrimethoxysilane
c)vinyltriethoxysilane

TABLE 1-B

| | | Inventive Chromating Liquid | | | | |
|---|---|---|---|---|---|---|
| | | H | I | J | K | L |
| Aqueous Chromating Liquid | $Cr^{6+}$ (g/l) | 20 | 10 | 40 | 30 | 12.5 |
| | $Cr^{3+}$(g/l) | 8 | 10 | 5 | 5 | 12.5 |
| | Hydrofluoric Acid (g/l) | 0 | 31.6 | 5.3 | 0.2 | $H_2ZrF_6$ 6 (g/l) |
| | Phosphoric Acid (g/l) | 30.9 | 40.3 | 12.9 | 0.3 | 15.5 |
| | $F^-$ + $PO_4^{3-}$ (g/l) | 30 | 70 | 17.5 | 0.5 | 18.3 |
| | $Cr^{6+}/Cr^{3+}$ | 2.5 | 1.0 | 8 | 6.0 | 1.0 |
| | $(F^- + PO_4^{3-})/Cr^{3+}$ | 3.75 | 7.0 | 3.5 | 0.1 | 1.6 |
| | $Zn^{2+}$ (g/l) *1 | 0 | 0 | 0 | 0 | 0 |
| | $Ni^{2+}$ (g/l) *2 | 0 | 0 | 0 | 0 | 0 |
| | Silane coupling agent (g/l) | — | — | a)5.4 | — | a)5.7 |
| | Molar ratio. Silane coupling Agent/$Cr^{6+}$ | | | 0.03 | | 0.10 |

*1 — ZnO is used for $Zn^{2+}$
*2 — $NiCO_3$ is used for $Ni^{2+}$
*3 — The silane coupling agent is the following a), b) or c) and is added to and blended with the aqueous chromating liquid. The so-prepared chromating liquid is applied on a steel sheet.
a)γ-glycidoxypropyltrimethoxysilane
b)γ-methacryloxypropyltrimethoxysilane
c)vinyltriethoxysilane

TABLE 2-A

| | | | | (Inventive Examples) Test Result of the Properties | | | | | | | |
|---|---|---|---|---|---|---|---|---|---|---|---|
| | | | | | Corrosion-Resistance | | Corrosion-Resistance of Painted Sheet | | Adhesion of Paint Coating | | |
| No. | Kinds of Zinc-based Plated Steel Sheet | Chromating Liquid | Amount Chromium in the Coating (mg/m²) | Alkali-Resistance (%) | Before Alkali-Cleaning | After Alkali-Cleaning | Salt Spray | Warm Salt Dip | Cross Cut Adhesion Test | Erichsen Test | Weldability Test |
| 1 | EG | A | 35 | 0 | ◎ | ◎ | 1.5 | 1.5 | ◎ | ◎ | — |
| 2 | " | B | 34 | 0 | ◎ | ◎ | 1.0 | 1.0 | ◎ | ◎ | — |
| 3 | " | C | 14 | 0 | ○ | ○ | 0.5 | 0.5 | ○ | ○ | — |
| 4 | " | D | 114 | 0.6 | ◎ | ○ | 2.0 | 2.0 | ○ | ○ | — |
| 5 | " | E | 68 | 0.8 | ◎ | ◎ | 1.5 | 2.0 | ◎ | ◎ | — |
| 6 | " | F | 57 | 0.5 | ◎ | ◎ | 2.0 | 1.5 | ◎ | ◎ | — |
| 7 | " | G | 72 | 0.6 | ◎ | ◎ | 1.5 | 1.5 | ○ | ○ | — |
| 8 | Zn—Ni | A | 33 | 0 | ◎ | ◎ | 1.0 | 1.0 | ◎ | ○ | — |
| 9 | " | B | 35 | 0 | ◎ | ◎ | 0.5 | 0.5 | ◎ | ◎ | — |
| 10 | " | C | 12 | 0 | ○ | ○ | 0.5 | 0.5 | ○ | ○ | — |
| 11 | " | D | 118 | 3.5 | ◎ | ○ | 1.5 | 1.5 | ◎ | ○ | — |
| 12 | " | E | 72 | 1.8 | ◎ | ◎ | 1.0 | 1.5 | ◎ | ○ | over 1000 |
| 13 | " | F | 57 | 0.5 | ◎ | ◎ | 1.5 | 1.0 | ◎ | ◎ | over 1000 |
| 14 | " | G | 71 | 1.7 | ◎ | ◎ | 1.0 | 1.0 | ○ | ○ | over 1000 |

Remarks:
EG — Zinc Electroplated Steel Sheet
Zn—Ni — Zn—Ni Electroplated Steel Sheet

TABLE 2-B

| | | | | (Comparative Examples) Test Result of the Properties | | | | | | | |
|---|---|---|---|---|---|---|---|---|---|---|---|
| | | | | | Corrosion-Resistance | | Corrosion-Resistance of Painted Sheet | | Adhesion of Paint Coating | | |
| No. | Kinds of Zinc-based Plated Steel Sheet | Chromating Liquid | Amount Chromium in the Coating ($mg/m^2$) | Alkali-Resistance (%) | Before Alkali-Cleaning | After Alkali-Cleaning | Salt Spray | Warm Salt Dip | Cross Cut Adhesion Test | Erichsen Test | Weldability Test |
| 1 | EG | H | 63 | 16.1 | Δ | x | 5.0 | 5.0 | x | x | — |
| 2 | " | I | 36 | 15.4 | x | x | 3.0 | 4.0 | x | x | — |
| 3 | " | J | 212 | 53.2 | ⊙ | Δ | 4.0 | 6.0 | x | x | — |
| 4 | " | K | 104 | 51.2 | ○ | x | 5.0 | 6.0 | Δ | Δ | — |
| 5 | " | C | 5 | 0.3 | x | x | 3.0 | 3.0 | x | x | — |
| 6 | Zn—Ni | H | 62 | 31.2 | Δ | x | 4.5 | 5.0 | Δ | x | — |
| 7 | " | I | 38 | 23.2 | Δ | x | 3.0 | 4.5 | x | x | — |
| 8 | " | J | 216 | 76.5 | Δ | Δ | 6.0 | 7.0 | x | x | — |
| 9 | " | K | 98 | 54.3 | Δ | Δ | 4.5 | 6.0 | x | Δ | — |
| 10 | " | L | 35 | 15.2 | Δ | Δ | 4.0 | 5.5 | Δ | Δ | — |

I claim:

1. A method for forming a chromate film on a zinc-based plated steel sheet, comprising applying a chromating liquid on a surface of the zinc-based plated steel sheet, and drying the applied chromating liquid, thereby forming the chromate film, the chromate film having a coating weight of from 10 to 150 $mg/m^2$ in terms of the chromium, wherein the chromating liquid is prepared by adding and mixing a silane coupling agent in a molar ratio of from 0.05 to 0.3 relative to hexavalent chromium ions contained in an aqueous chromating liquid, which consists of from 1 to 30 g/l of hexavalent chromium ions and from 1 to 30 g/l of trivalent chromium ions at a weight ratio of the hexavalent chromium ions/trivalent chromium ions ranging from 0.1 to 2.0; and from 1 to 59 g/l of hydrofluoric acid and from 1 to 59 g/l of phosphoric acid at total of the hydrofluoric acid and the phosphoric acid ranging from 2 to 60 g/l and at a weight ratio of (fluoride ions+phosphate ions)/trivalent chromium ions ranging from 0.5 to 3.5; the balance being water and optionally zinc ions and nickel ions.

2. A method according to claim 1, wherein said aqueous chromating liquid contains at least one metal ion selected from the group consisting of from 0.1 to 10 g/l of zinc ions and from 0.1 to 10 g/l of nickel ions.

3. A method according to claim 1 or 2, wherein said silane coupling agent has the formula (1) or (2):

$$(YR)_mSiX_n \quad (1)$$

$$Y_mSiX_n \quad (2)$$

m+n=4 and n=1−3

R: alkyl group

X: hydrolyzable group bonded to the silicon atoms

Y: organic functional group.

4. A method according to claim 2, wherein the molar ratio of the silane coupling agent relative to the hexavalent chromium ions is from 0.1 to 0.2.

5. A method according to claim 2, wherein the drying is carried out at a temperature less than 100° C. and for a time shorter than 5 seconds.

6. A method according to claim 3, wherein the hydrolyzable group bonded to the silicon atom is selected from the group consisting of methoxy and ethoxy groups.

7. A method according to claim 3, wherein the organic functional group is selected from the group consisting of vinyl group, mercapto group, glycidoxy group and methacryloxy group.

8. A method according to claim 1, wherein the trivalent chromium is formed by reducing hexavalent chromium by means of an organic reducing agent added to the aqueous chromating liquid.

* * * * *